United States Patent [19]

Andress et al.

[11] Patent Number: 4,522,736

[45] Date of Patent: Jun. 11, 1985

[54] PRODUCTS OF REACTION INVOLVING ALKENYLSUCCINIC ANHYDRIDES WITH AMINOALCOHOLS AND AROMATIC SECONDARY AMINES AND LUBRICANTS CONTAINING SAME

[75] Inventors: Harry J. Andress, Wenonah; Henry Ashjian, E. Brunswick, both of N.J.

[73] Assignee: Mobil Oil Corporation, New York, N.Y.

[21] Appl. No.: 603,274

[22] Filed: Apr. 24, 1984

Related U.S. Application Data

[63] Continuation-in-part of Ser. No. 443,500, Nov. 22, 1982, abandoned.

[51] Int. Cl.[3] ..... C10M 1/32

[52] U.S. Cl. ..... 252/51.5 A; 549/233

[58] Field of Search ..... 252/51.5 A; 549/233; 548/545

[56] References Cited

U.S. PATENT DOCUMENTS

| | | | |
|---|---|---|---|
| 2,783,206 | 2/1957 | Messina | 252/51.5 A |
| 3,219,666 | 11/1965 | Norman et al. | 252/51.5 A X |
| 3,862,981 | 1/1975 | Demoures et al. | 252/51.5 A X |
| 3,936,480 | 2/1976 | Demoures et al. | 252/51.5 A X |
| 3,991,056 | 11/1976 | Okamoto et al. | 252/51.5 A X |
| 4,219,431 | 8/1980 | Chibnik | 252/51.5 A X |
| 4,391,721 | 7/1983 | Pappas | 252/51.5 A |

*Primary Examiner*—Andrew Metz

*Attorney, Agent, or Firm*—Alexander J. McKillop; Michael G. Gilman; Claude E. Setliff

[57] ABSTRACT

It has been found that products made by reacting a polyalkenylsuccinic compound with an aromatic secondary amine or hindered phenol containing a hydroxyalkyl group, followed by reaction with an alkanolamine or an aminomethane, give a novel additive having utility as a dispersant and/or an anticorrosion agent when placed in a lubricant.

23 Claims, No Drawings

PRODUCTS OF REACTION INVOLVING ALKENYLSUCCINIC ANHYDRIDES WITH AMINOALCOHOLS AND AROMATIC SECONDARY AMINES AND LUBRICANTS CONTAINING SAME

CROSS REFERENCE

This application is a continuation-in-part of copending application Ser. No. 443,500, filed Nov. 22, 1982 now abandoned.

BACKGROUND OF THE INVENTION

1. Field of the Invention

The invention relates to nitrogen-containing reaction products and to their use in lubricant compositions. More particularly, the reaction products are made by reacting alkenylsuccinic anhydrides with an aminoalcohol and an aromatic secondary amine or phenol, the phenol having, in addition to the hindering groups, a hydroxyhydrocarbyl group.

2. Discussion of Previous Disclosures

It is known that in the normal use of organic industrial fluids, such as lubricating oils, transmission fluids, bearing lubricants, power transmitting fluids and the like, the base medium is subjected to oxidizing conditions which may result in the formation of sludge, lacquers, corrosive acids and the like. These products are undesirable in the equipment in which the industrial fluid is used. The oxidation residues or heavy contaminants may interfere with the normal operation of the fluid, increase its viscosity, and even cause severe damage to the parts of the equipment themselves.

In the lubrication of modern engines, particularly, oil compositions must be able to prevent acids, sludge and other solid contaminants from remaining near the moving metal parts. Poor piston travel and excessive engine bearing corrosion may result, unless the oil can prevent the sludge and oxidation products from depositing in the engine. Bearing corrosion is another serious problem in gasoline engines which operate at an oil temperature of about 300° F. or higher.

The most desirable way of decreasing these difficulties is to add to the base organic fluid a detergent or dispersant additive capable of dispersing the solid particles to prevent them from interfering with the normal operation of the equipment, and leaving the metal surfaces relatively clean. Today, with modern equipment operating under increasingly strenuous conditions, it is desirable to develop new detergents which have improved dispersant properties, which are soluble in the fluid medium to which they are added, and which are themselves stable therein.

U.S. Pat. No. 3,714,045 discloses lubricant compositions containing lubricants and a polyimide produced by reacting (1) a heteropolymer produced by reacting an olefin with moleic anhydride in the presence of a free-radical initiator with (2) a primary arylamine.

U.S. Pat. No. 3,936,480 discloses the reaction of a polyalkylenesuccinic acid anhydride with diphenylolpropane of the formula

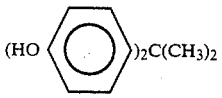

and tetraethylenepentamine, pyridine or triethylenetetramine. It should be noted however, that in all cases wherein diphenolpropane is reacted, a catalyst is used. This is an absolute necessity when a phenolic OH is present, because there will be no reaction with the anhydride without it.

SUMMARY OF THE INVENTION

In accordance with the invention, there are provided (1) a product made by (a) reacting a polyalkenylsuccinic compound with a compound selected from the group consisting of (i) a diaromatic secondary amine of the formula:

$$ArNHAr^1$$

wherein Ar and $Ar^1$ are the same or different aromatic groups, or the substituted member thereof, having 6 to 50 carbon atoms, (ii) a hindered phenol of the formula:

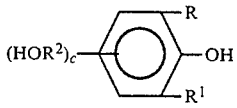

wherein R and $R^1$ are the same or different groups selected from the group consisting of chloro, alkoxyl, acyloxy groups and hydrocarbyl groups containing 1 to 18 carbon atoms, $R^2$ is a $C_1$ to $C_{18}$ alkylene group and c is 1 to 3, and (iii) mixtures of (i) and (ii), and (b) reacting the product of (a) with a compound selected from the group consisting of an alkanolamine and a hydroxyalkyl aminomethane of the formulas:

$$(HOR^3)_xN(H)_y$$

and $$(HOR^4)_{x'}C(H)_{y'}NH_2$$

wherein $R^3$ is an alkylene group having 1 to 6 carbon atoms, x is 1 to 3, y is 0 to 2, their sum beinge 3, x' and y' have the same meaning as x and y and $R^4$ is the same as $R^3$, and (2) a lubricant composition comprising a major amount of a lubricant and a minor detergent or anticorrosion amount of the reaction product.

The Ar and $Ar^1$ substituents may be an aliphatic group, preferably an alkyl group, containing from 1 to 44 carbon atoms. The aromatic group Ar and $Ar^1$ will preferably contain no more than 14 carbon atoms. Preferred specific amines are diphenylamine, phenyl-alpha-naphthylamine and their alkylated derivatives.

Substituent groups R and $R^1$ may be alkyl or aralkyl, or they may be a chloro group, an alkoxyl group or an acyloxy group. Preferably R and $R^1$ will have 1 to 12 carbon atoms and more preferably both R and $R^1$ will be selected from among t-octyl, t-dodecyl, di-t-dodecyl, t-butyl and di-t-butyl groups, $R^2$ may be, for example, methyl, ethyl, butyl, hexyl, octyl, decyl, dodecyl, pentadecyl, octadecyl or eicosyl group.

The preferred alkanolamine is triethanolamine, and the preferred aminomethane is tris(hydroxymethyl-)aminomethane.

DESCRIPTION OF SPECIFIC EMBODIMENTS

The reactions can, broadly, be carried over a wide range of from about 50° C. to about 300° C. in from about 0.5 hour to about 10 hours, depending on temperature and reactivity of the reactants. For specific reactions, the temperatures of reaction can be from about 50° C. to about 250° C., preferably about 100° C. to about 200° C. for the reaction between the alkenylsuccinic compound and the diarylamine or hindered phenol. When carrying out the reaction of the alkenylsuccinicdiarylamine or- hindered phenol product with the aminomethane or alkanolamine, the temperature will generally be from about 100° C. to about 300° C., preferably about 150° C. to about 275° C. Times will run from about 1 hour or less to about 10 hours.

The alkenyl group of the alkenylsuccinic compound, preferably the anhydride or the acid, can have a number average molecular weight of from about 360 to about 1800, i.e., it will have from 30 to 150 carbon atoms. They (the alkenyl groups) may be made by any method known to the art, as by the catalytic oligomerization of an olefin, such as one containing 2 to 10 carbon atoms. Further, the oligomer so produced can be reacted with maleic anhydride by well known methods (as by $BF_3$ catalysis) to give the alkenylsuccinic compound.

While the reaction sequence has been disclosed to be reaction of (1) alkenylsuccinic compound and diarylamine or hindered phenol and (2) reaction of (1) with an alkanolamine, the invention is not limited to that method. For example, the alkanolamine may be reacted with the alkenylsuccinic compound, followed by reaction of the product thus obtained with the diarylamine or hindered phenol. The same times and temperatures mentioned above for reactions involving diarylamine, hindered phenol or alkanolamine will generally apply in such reactions. Furthermore, all reactants can be mixed and reacted in one step, in which case the temperature again can be from about 50° C. to about 300° C. and the time from about 0.5 hour to about 10 hours.

The reactants can be used in the range of about 0.1 to about 1.0 mole of diarylamine or phenol per mole of alkenylsuccinic compound and from about 0.1 to 1.2 moles of alkanolamine or aminomethane per mole of alkenylsuccinic compound. The preferred amounts of reactants are 1.0 mole of alkenylsuccinic compound, 1.0 mole of diarylamine or hindered phenol and no more than about 0.6 mole of the alkanolamine or aminomethane.

The products of the invention are used in minor dispersant or anticorrosion amounts with a major proportion of a lubricating oil or grease. In general, this will amount to from about 0.05% to about 15% by weight of the total composition. Furthermore, other additives, such as other detergents, antioxidants, antiwear agents and the like may be present. These can include phenates, sulfonates, succinimides, zinc dithiophosphates, polymers, calcium and magnesium salts and the like.

It should be noted that, when using our hindered phenol, the only reaction that can take place is with the hydroxyalkyl group to form the ester at that point. Furthermore, even if we were to use the Demoures catalyst (p-toluenesulfonic acid), no reaction would take place at the phenolic OH because it is effectively blocked from reaction.

The lubricants contemplated for use with the products herein disclosed include mineral and synthetic hydrocarbon oils of lubricating viscosity, mixtures of mineral oils and synthetic oils, including mixtures. The synthetic hydrocarbon oils include long-chain alkanes such as cetanes and olefin polymers such as oligomers of hexene, octene, decene, and dodecene, etc. The products of this invention are especially effective in synthetic oils formulated using mixtures of synthetic hydrocarbon olefin oligomers and lesser amounts of hydrocarbyl carboxylic ester fluids. Other synthetic oils, which can be ixed with a mineral or synthetic hydrocarbon oil, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxlic acids and monohydric alcohols. More preferred are the ester fluids made by fully esterfying pentaerythritol, or mixtures thereof with di- and tripentaerythritol, with an aliphatic monocarboxylic acid containing from 1 to 20 carbon atoms, or mixtures of such acids.

Having described the invention with reference to its broader aspects, the following are offered to specifically illustrate it. It will be understood that the Examples are for illustration only and are not intended to limit the scope of the invention.

EXAMPLE 1

A mixture of 676 grams (0.48 mol) of polybutenylsuccinic anhydride and 105 grams (0.48 mol) of phenyl-alpha-naphthylamine was stirred at 160° C. for about three hours. The reaction mixture was then cooled to about 100° C. and 50 grams (0.34 mol) of triethanolamine were added. The mixture was then stirred to about 265° C. over a six hour period using a stream of nitrogen to remove water formed during the reaction. The final product was obtained by filtration.

EXAMPLE 2

A mixture of 1800 grams (1.0 mol) of polybutenylsuccinic anhydride and 169 grams (1.0 mol) of diphenylamine was stirred for three hours at 160° C., then allowed to cool to 75° C. At this point, 121 grams (1 mol) of tris(hydroxymethyl)aminomethane were added and the mixture stirred to 250° C. over a six hour period. After blowing with nitrogen, the final product was obtained by filtration.

EXAMPLE 3

A mixture of 1800 grams (1.0 mol) of polybutenylsuccinic anhydride and 169 grams (1.0 mol) of diphenylamine was stirred for three hours at 160° C. After cooling to 100° C., 112 grams (0.75 mll) of triethanolamine were added and the mixture stirred to 225° C. over a six hour period. After flowing with nitrogen, the final product was obtained by filtration.

EXAMPLE 4

A mixture of 1800 grams (1.0 mol) of polybutenylsuccinic anhydride and 236 grams (1 mol) of para-hydroxymethyl-2,5-di-tertiary-butylphenol was stirred at 175° C. for four hours. After cooling to 100° C., 87.4 grams (0.6 mol) of triethanolamine were added and the mixture stirred to about 255° C. over a six hour period. The final product was obtained by blowing with nitrogen and filtering.

EXAMPLE 5

A mixture of 1800 grams (1.0 mol) of polybutenylsuccinic anhydride and 118 grams (0.5 mol) of para-hydroxymethyl-2,6-di-tertiary-butylphenol was stirred at 200° C. for two hours. After cooling to 150° C., 84.5 grams (0.5 mol) of diphenylamine were added and the mixture stirred at 200° C. for two hours. After cooling to 150° C., 87.4 grams (0.6 mol) of triethanolamine were added and the mixture stirred to about 250° C. over a five hour period. The final product was obtained by blowing with nitrogen and filtering.

EVALUATION OF PRODUCTS

The products of this invention were tested in lubricating oils in a Caterpillar engine test, the conditions of which are as follows:

An oil composition consisting of a blend of solvent refined mineral oils (KV at 210° F. of 11 cs) was used as the base fluid. To this was added 4.2% by weight (pure basis) of Examples 1 through 7.

The test engine was a single cylinder 4-cycle Caterpillar engine operated under the following conditions:

Speed, RPM: 1000
Brake Load, HP: 19.8
Oil Temperature, °F.: 150
Jacket Temperature, °F.: 150
Fuel: Diesel fuel containing 1 percent sulfur The engine is operated for 480 hours, ratings being made after 240 hours and 480 hours. These ratings are made in accordance with the Coordinating Research Council rating system for diesel pistons. With this system 0 is clean and the maximum piston density allowed is 17,450.

All percentages were by weight. The following results were obtained:

TABLE

| | Caterpillar 1-6 Test* | | |
|---|---|---|---|
| Example No. | Conc. Wt. % | Top Groove Packing | Weighted Total Demerits |
| 1 | 4.2 | 3.0 | 130.1 |
| 2 | 4.2 | 12.0 | 120.0 |
| 3 | 4.2 | 2.0 | 58.0 |
| 4 | 4.2 | 10.0 | 59.0 |
| 5 | 4.2 | 10.0 | 88.0 |
| 7 (a commercial dispersant) | 4.2 | 75.0 | 152.0 |

*The test procedure is additionally described in U.S. Pat. No. 4,292,186, a hereby incorporated herein by reference. The base oil composition comprises a blend of solvent refined mineral oils containing overbased calcium sulfonate, overbased calcium phenate, normal calcium sulfonate, zinc dithiophosphate and a hindered phenol antioxidant.

We claim:

1. A product of reaction made by (a) reacting an alkenylsuccinic compound selected from the group consisting of an alkenylsuccinic acid and the anhydride thereof with a diaromatic secondary amine of the formula $$ArNHAr^1$$

wherein Ar and $Ar^1$ may be the same or different aromatic group having 6 to 50 carbon atoms or the $C_1$ to $C_{44}$ aliphatic group substituted member thereof, the reaction being carried out at from about 50° C. to about 250° C. using from about 0.1 to about 1.0 mole of said secondary amine per mole of acid or anhydride, followed by (b) reacting the product of (a) with a compound selected from the group consisting of an alkanolamine of the formula $$(HOR^3)_xN(H)_y$$

wherein $R^3$ is an alkylene group having 1 to 6 carbon atoms, x is 1 to 3 and y is 0 to 2, their sum being 3, and an aminomethane of the formula $$(HOR^4)_{x'}C(H)_{y'}NH_2$$

wherein $R^4$ is the same as $R^3$ and x' and y' have the same meaning as x and y, the reaction in (b) being carried out at from about 100° C. to about 300° C. using from about 0.1 mole to about 1.2 moles of amine reactant per mole of acid or anhydride used in (a).

2. The product of claim 1 wherein the secondary amine is diphenylamine or phenyl-alpha-naphthylamine.

3. The product of claim 1 wherein the aliphatic group is an alkyl group.

4. The product of claim 1 wherein the alkanolamine is triethanolamine.

5. The product of claim 1 wherein the aminomethane is a tris(hydroxymethyl)aminomethane.

6. The product of claim 1 wherein in the alkenylsuccinic compound the alkenyl portion has from 30 to 150 carbon atoms.

7. The product of claim 1 wherein the alkenylsuccinic compound is polybutenylsuccinic anhydride, the polybutenyl having a number average molecular weight of about 1300, the secondary amine is phenyl-alpha-naphthylamine and the alkanolamine is triethanolamine.

8. The product of claim 1 wherein the alkenylsuccinic compound is polybutenylsuccinic anhydride, the polybutenyl having a number average molecular weight of about 1700, the secondary amine is diphenylamine and the aminomethane is tris(hydroxymethyl)aminomethane.

9. The product of claim 1 wherein the alkenylsuccinic compound is polybutenylsuccinic anhydride, the polybutenyl having a number average molecular weight of about 1700, the secondary amine is diphenylamine and the alkanolamine is triethanolamine.

10. A lubricant composition comprising a major proportion of a lubricating oil or grease therefrom and from about 0.05 to about 15% by weight of the composition of a product of reaction made by (a) reacting an alkenylsuccinic compound selected from the group consisting of an alkenylsuccinic acid and the anhydride with a diaromatic secondary amine of the formula $$ArNHAr^1$$

wherein Ar and $Ar^1$ may be the same or different aromatic group having 6 to 50 carbon atoms or the $C_1$ to $C_{44}$ aliphatic group substituted member thereof, the reaction being carried out at from about 50° C. to about 250° C. using from about 0.1 to about 1.0 mole of said secondary amine per mole of acid or anhydride, followed by (b) reacting the product of (a) with a compound selected from the group consisting of an alkanolamine of the formula $$(HOR^3)_xN(H)_y$$

wherein $R^3$ is an alkylene group having 1 to 6 carbon atoms, x is 1 to 3 and y is 0 to 2, their sum being 3, and an aminomethane of the formula $$(HOR^4)_{x'}C(H)_{y'}NH_2$$

wherein $R^4$ is the same as $R^3$ and x' and y' have the same meaning as x and y, the reaction in (b) being carried out at from about 100° C. to about 300° C. using from about 0.1 mole to about 1.2 moles of amine reactant per mole of acid or anhydride used in (a).

11. The composition of claim 10 wherein the secondary amine is diphenylamine or phenyl-alpha-naphthylamine.

12. The composition of claim 10 wherein the aliphatic group is an alkyl group.

13. The composition of claim 10 wherein the alkanolamine is triethanolamine.

14. The composition of claim 10 wherein the aminomethane is tris(hydroxymethyl)aminomethane.

15. The composition of claim 10 wherein in the alkenylsuccinic compound the alkenyl portion has from 30 to 150 carbon atoms.

16. The composition of claim 10 wherein the alkenylsuccinic compound is polybutenylsuccinic anhydride, the polybutenyl having a number average molecular weight of about 1300, the secondary amine is phenyl-alpha-naphthylamine and the alkanolamine is triethanolamine.

17. The composition of claim 10 wherein the alkenylsuccinic compound is polybutenylsuccinic anhydride, the polybutenyl having a number average molecular weight of about 1700, the secondary amine is diphenylamine and the aminomethane is tris(hydroxymethyl)aminomethane.

18. The composition of claim 10 wherein the alkenylsuccinic compound is polybutenylsuccinic anhydride, the polybutenyl having a number average molecular weight of about 1700, the secondary amine is diphenylamine and the alkanolamine is triethanolamine.

19. The composition of claim 10 wherein the lubricant is a lubricating oil.

20. The composition of claim 19 wherein the lubricating oil is a mineral oil.

21. The composition of claim 19 wherein the lubricating oil is a synthetic oil.

22. The composition of claim 19 wherein the lubricating oil is a mixture of mineral and synthetic oils.

23. The composition of claim 10 wherein the lubricant is a grease.

* * * * *